US006068709A

United States Patent [19]

Schapira et al.

[11] Patent Number: 6,068,709

[45] Date of Patent: May 30, 2000

[54] BATH AND PROCESS FOR THE PHOSPHATIZATION OF METALLIC SUBSTRATES, CONCENTRATES FOR THE PREPARATION OF SAID BATH AND METALLIC SUBSTRATES HAVING BEEN SUBJECTED TO A TREATMENT BY SAID BATH AND PROCESS

[75] Inventors: Joseph Schapira, Paris; Patrick Droniou, Colombes; Michel Sudour, Saint Martin Du Tertre; Michèle Guimon, Montigny les Cormeilles; Daniel Bernard, Epinay sur Seine, all of France

[73] Assignee: CFPI Industries, Gennevilliers, France

[21] Appl. No.: 08/921,877

[22] Filed: Sep. 2, 1997

[30] Foreign Application Priority Data

Sep. 2, 1996 [FR] France ..... 96 10684

[51] Int. Cl.[7] ..... C23C 22/07

[52] U.S. Cl. ..... 148/253; 148/262; 148/273; 148/275

[58] Field of Search ..... 148/252, 253, 148/254, 260, 262, 273, 275

[56] References Cited

U.S. PATENT DOCUMENTS

| | | | |
|---|---|---|---|
| 3,420,715 | 1/1969 | Ayres | 148/253 |
| 4,540,494 | 9/1985 | Fuchs et al. | 210/750 |
| 4,717,431 | 1/1988 | Knaster et al. | 148/252 |
| 5,298,092 | 3/1994 | Schriever | 148/275 |

FOREIGN PATENT DOCUMENTS

| | | |
|---|---|---|
| 0 458 020 | 3/1991 | European Pat. Off. . |
| 0 488 430 | 8/1991 | European Pat. Off. . |
| 599 728 | 3/1948 | United Kingdom . |
| 599 784 | 3/1948 | United Kingdom . |
| WO94/00619 | 6/1993 | WIPO . |

*Primary Examiner*—John Sheehan
*Assistant Examiner*—Andrew L. Oltmans
*Attorney, Agent, or Firm*—Jones & Askew, LLP

[57] ABSTRACT

The invention relates to a process for the phosphatization of metallic substrates comprising the use of a phosphatization bath having a pH from 1 to 5.5 and which comprises from about 0.3 to about 25 g/l of zinc ion, preferably from 0.5 to 10 g/l, from 5 to about 50 g/l of phosphate ion, preferably from 8 to 30 g/l, and from about 0.01 to about 10 g/l, preferably from 0.03 to 3 g/l of a trivalent cobalt complex.

4 Claims, No Drawings

BATH AND PROCESS FOR THE PHOSPHATIZATION OF METALLIC SUBSTRATES, CONCENTRATES FOR THE PREPARATION OF SAID BATH AND METALLIC SUBSTRATES HAVING BEEN SUBJECTED TO A TREATMENT BY SAID BATH AND PROCESS

The invention relates to a bath and to a process for the phosphatization of metallic substrates as well as a metallic substrate having been subjected to said treatment by the said bath and process.

It also relates to a concentrate for the preparation of the said bath.

Baths and processes for the phosphatization of metallic substrates have already been disclosed in the prior art.

The said known baths and processes enable the formation of phosphate coatings, essentially of zinc or of iron and zinc at the surface of the treated metallic substrates.

Phosphate coatings are interesting because they provide the said surfaces with a good resistance against corrosion and because they improve the adherence to the said surfaces of paints or of electrophoretic coatings applied subsequently.

The metallic substrates in question are those based on steel, possibly coated with zinc or with alloys of zinc with other metals like iron, nickel, aluminum, manganese, as well as those based on aluminum or aluminum alloys.

Generally, phosphatization baths are applied by immersion or dipping, aspersion or by combinations of these methods which may comprise the use of application rollers.

The said baths consist of acid aqueous solutions containing phosphate ions, fluorides (simple and/or completed with one or several elements selected from silicon, boron, zirconium and titanium), nitrates, bivalent cations such as zinc, as well as those from the group comprising Mn, Mg, Ni, Cu, Ca, Fe and monovalent cations such as Na.

They also may contain polyoses, derivatives of sugar, heteropolysaccharides and glucose.

It is well known that, in the baths and processes of the kind in question, the speed of formation of the phosphatization deposit is increased by the use of accelerators.

The accelerators which are classically used are those of the group comprising nitrites, the chlorates of alkaline metals, m-nitrobenzene sulphonate, hydrogen peroxide, and more recently hydroxylamine and various combinations of these compounds.

It has been proposed to explain their action by the oxidation of $Fe^{2+}$ ions, possibly present in the bath, into $Fe^{3+}$ ions eliminated under the form of ferric slurries; as a matter of fact, the increase of the proportion of $Fe^{2+}$ ions during the treatment must be avoided as it could inhibit the phosphatization.

According to another explanation of their action, they permit the depassivation of the substrates corroded by the acidity of the phosphatizing solution, according to the following reaction:

$$\text{Metal}+\text{Acid } H^+ \leftrightharpoons \text{Metal ion}+\text{Hydrogen } H_2$$

It so happens that all the classically used accelerators present these drawbacks.

In that connexion, nitrite ions present the major drawback of being unstable in acid medium and of decomposing into nitrogen oxides; a permanent feeding of these baths with nitrite ions is consequently necessary even in the absence of a consumption linked to the treatment of the samples; another drawback of the nitrite ions precisely lies in the fact that they decompose into nitrogen oxides which are well known for their dangerous character, which raises problems linked to the security of the workers.

The use of chlorate ions leads, after the reaction, to the formation of chloride ions well-known as being detrimental with regard to the resistance against corrosion of the coatings obtained; furthermore, they promote the appearance of white points in the said coatings during the treatment of certain substrates treated with zinc, compelling the user to pumice or rub manually the treated substrates.

Hydrogen peroxide is not stable in an acid conversion bath containing the metals recited hereabove, and its range of optimal concentration is very narrow, which makes it difficult to control the bath industrially; furthermore, this bath has a tendancy to produce important quantities of slurries during its use, the slurries which must be eliminated as waste.

m-nitrobenzene sulphonate cannot be easily dosed on the treatment line (this dosage necessitates the use of chromatographical techniques whose cost and technicality are not compatible with an acceptable cost price); furthermore, its use leads to the generation of important quantites of slurries.

Hydroxylamine, in order to provide good results, must be used at concentrations leading to relatively high costs, and above all its degradation can be important in the presence of metallic ions at a high phosphatization temperature.

The object of the invention is above all to propose to the user an accelerator for phosphatization baths and processes which no longer present the drawbacks of those of the prior art.

And the Applicants had the merit of having found that, surprisingly and unexpectedly, this object could be reached when a trivalent cobalt complex is used as accelerator for phosphatization baths and processes.

Consequently, the phosphatization bath according to the invention whose pH is from about 1 to about 5.5, which comprises the classical components of phosphatization baths, is characterized by the fact that it comprises:

from about 0.3 to about 25 g/l of zinc ion, preferably from 0.5 to 10 g/l, from about 5 to about 50 g/l of phosphate ion, preferably from 8 to 30 g/l, and from about 0.01 to about 10 g/l, preferably from 0.03 to 3 g/l of a trivalent cobalt complex represented by one of the formulae:

$$[Co(Ligand)_n]^c \quad \text{(I)}$$

$$[Co(Ligand)_n Z_p]^c \quad \text{(II)}$$

in which n and p are integers from 1 to 6 with the proviso that, in case of formula (II), $n+p \leqq 6$, c represents the charge of the complex and can consequently be positive or negative according to the charge of the Ligand and of Z, the Ligand is selected among the ions of the group comprising $NO_2$, CN, $CO_3$ and $SO_3$, among the ions of the group comprising oxalate ions, acetate ions, citrate ions, gluconate ions, tartrate ions and acetylacetonate ions, and among the compounds of formula $N(R_1, R_2, R_3)$ wherein $R_1$, $R_2$ and $R_3$ are selected, independently from one another, in the groups comprising H, the carbonated groups in $C_1$ to $C_6$ among which especially alkyl, hydroxyalkyl, hydroxy, alkylamine, hydroxyalkylamine groups as well as carboxylic or aminocarboxylic acids and their salts,and Z is selected in the group comprising Cl, Br, F, I, OH, $NO_3$, SCN, $PO_4$, $SO_4$, $S_2O_3$, $MoO_4$, $SeO_4$ and $H_2O$, it being understood that the given complex can comprise one or several Ligands and one or several Zs, different from each other.

The merit of the Applicants is all the more important as the known uses of the complexes of trivalent cobalt in no case permit the forcasting of the applicability of these products as accelerators in phosphatization baths and processes.

In that connection, it is important to state that until now (see the document EP-A-0 458 020) the only known use of trivalent cobalt complexes was of their use in the surface treatments of substrates essentially based on aluminum in view of the formation on these surfaces of conversion coatings instead of the carcinogenic hexavalent chrome derivatives; phosphatization treatments were not contemplated; the thus obtained conversion coatings contain aluminum oxide as major constituent, at least in volumic percentage, and cobalt oxides CoO, $Co_3O_4$ and $Co_2O_3$; due to the use of liquid ammonium in the processes disclosed by EP-A-0 458 020, the conversion reaction takes place at a pH comprised between 5 and 9.5.

The abovesaid trivalent cobalt complexes are stable at acid pH from 1 to 5.5, preferably from 2.5 to 3.5, contrary to simple salts of Cobalt III such as $CoF_3$ which decomposes into an insoluble black oxide in phosphatization baths.

These complexes are mostly described under their ionic form; when they consist of cationic complexes, the associated anion is for example one of the anions of the group comprising Cl, Br, F, I, $NO_3$, CN, SCN, $PO_4$, $SO_4$ and acetate; when they are anionic complexes, the associated cation is for example one of the cations of the group comprising Na, K, Li, Mg, Ca and $NH_4$.

In a preferred embodiment of the phosphatization bath according to the invention, the trivalent cobalt complex is selected from the group comprising:

$[Co(NH_3)_6]Cl_3$ $(Co(NO_2)_6]Na_3$ $[Co(en)_3](NO_3)_3$ with en=ethylenediamine $[Co(pn)_3](NO_3)_3$ with pn=diamino 1-2 propane $[Co(oxalate)en_2]NO_3$ $[Co(citrate)(CO_3)]Na_2$ $[CoF(NH_3)_5](NO_3)_2$ $[Co(NO_3)(NH_3)_5](NO_3)_2$.

The phosphatization bath according to the invention may contain a classical accelerator in addition to the accelerator consisting of the trivalent cobalt complex.

The phosphatization process according to the invention, which comprises the successive stages of classical phosphatization processes, among which especially:

a degreasing step, a rinsing step, the phosphatization step proper, a rinsing step and a drying step, is characterized by the fact that, during the phosphatization step proper, the phosphatization bath according to the invention is used.

The metallic substrate according to the invention, which is obtained by use of the phosphatization process according to the invention, is characterized by the presence of cobalt in the phosphate coating.

The invention also relates to the concentrate adapated to provide, by dilution from about 1% to about 10% with water, the phosphatization bath according to the invention.

The phosphate coatings obtained due to the invention present a fineness and an homogeneity at least equivalent to those of the coatings obtained by use of the accelerators of the prior art.

Furthermore, their stability is excellent.

The results recorded due to the invention when using a trivalent cobalt complex as accelerator, clearly appear when reading the non-limiting comparative examples which follow.

In these examples, a metallic substrate consisting of steel plates or of electrogalvanized steel plates whose dimensions are lenghth: 180 mm width: 90 mm thickness: 0.8 mm is subjected to the the sequence of treatments resulting from table A.

TABLE A

| Step | Type of treatment | Products | T (° C.) and duration (min) |
|---|---|---|---|
| degreasing | dipping | Ridoline 1550 CF/4 2% w/w + Ridosol 550 CF 0.2% w/w | 60° C. 5 minutes |
| rinsing | dipping | tap water | 20° C. 1 minute |
| refining | dipping | Fixodine 50 CF 0.05% w/w in demineralized water | 20° C. 1 minute |
| phosphatization | dipping | according to the compositions indicated in tables B, C and D | 55° C. 3 minutes |
| rinsing | dipping | demineralized water | 20° C. 1 minute |
| drying | hot air | | |

Ridoline 1550 CF/4 = alkaline product based on potassium hydroxide and silicates marketed by CfPI Industries Company
Ridosol 550 CF = acid product based on non-ionic surfactive agents marketed by the Applicant Company
Fixodine 50 CF = neutral product based on Na and Ti phosphates marketed by the Applicant Company Free acidity of the phosphatization bath is measured by the quantity (in ml) of NaOH N/10 necessary to bring the pH of 10 ml of the said bath to 3.6.

On the treated plates, determination was made of the structure of the crystalline coating by observation on scanning electron microscopy (SEM) in order to obtain the crystals size and the surface coverage percentage, the coating weight by the measure according to the standard ISO 3892, the salt spray resistance (SS) according to the standard ISO 9227.

In the case of metallic substrates coated with a paint of the polyester laquer type of Saultain white color marketed by the Company PPG, reference Y 143 W 408, the duration of the salt spray test is 96 hours, the said paint having performances which are much lower than those of a cataphoretic paint.

The evaluation is performed by measuring the width of corrosion creepage perpendicularly to the scribe.

The requirement corresponds to a creepage value which is lower or equal to 8 mm.

The paint adherence is evaluated using square willing test carried out according to the standard ISO 2409.

The requirement corresponds to an adherence evaluation at most equal to 2.

In the case of the phosphated substrates coated with a cataphoretic paint marketed by the Company PPG under the reference W 742/962, the "Climatic Change Corrosion" test (or "3C" test) according to the Renault standard D17 1686/D was carried out.

This test consists in a succession of 9 cycles of one week each comprising the following phases:

24 hours of salt spray according to the standard ISO 9227, 4 times a cycle of 8 hours at 40° C. and under 95 to 100% of relative humidity (RH), and of 16 hours at 20° C. and under 70 to 75% RH, 48 hours at 20° C. and under 60 to 65% RH.

The evaluation is performed by measuring the width of corrosion creepage perpendicularly to the scribe. The requirement corresponds to a creepage value which is lower than or equal to 3.5 mm.

EXAMPLE 1

16 tests (A to P) were carried out using eight accelerators according to the invention, i.e.:

| | |
|---|---|
| Accelerator 1 | $[Co(NH_3)_6]Cl_3$ |
| Accelerator 2 | $[Co(NO_2)_6]Na_3$ |
| Accelerator 3 | $[Co(en)_3](NO_3)_3$ with en = ethylenediamine |
| Accelerator 4 | $[Co(pn)_3](NO_3)3$ with pn = diamino 1-2 propane |
| Accelerator 5 | $[Co(oxalate)en_2]NO_3$ |
| Accelerator 6 | $[Co(citrate)(CO_3)]Na_2$ |
| Accelerator 7 | $[COF(NH_3)_5](NO_3)_2$ |
| Accelerator 8 | $[Co(NO_3)(NH_3)_5](NO_3)_2$ |

an accelerator consisting of a cobalt salt:

| | |
|---|---|
| Accelerator 9 | $COF_3$ Cobalt III salt |

an accelerateur consisting of a divalent cobalt complex:

| | |
|---|---|
| Accelerator 10 | $[Co(NH_3)_6]Cl_2$ Cobalt II complex |

and an accelerator according to the prior art, i.e. the accelerator 11 which is sodium nitrite $NaNO_2$.

The compositions of the baths corresponding to the eleven tests, the nature of the substrates (steel or electrogalvanized steel EGS), the crystals size and the surface coverage percentage result from table B.

TABLE B

| | | Concentration (ppm) of the phosphatization baths in the baths | | | | | | | |
|---|---|---|---|---|---|---|---|---|---|
| | | A | B | C | D | E | F | G | H |
| Constituents of the phosphatization bath | Zn | 1025 | 1025 | 1025 | 1025 | 1025 | 1025 | 1025 | 1025 |
| | $PO_4$ | 10550 | 10550 | 10550 | 10550 | 9860 | 10550 | 10550 | 10550 |
| | Ni | 210 | 210 | 210 | 210 | 0 | 210 | 210 | 210 |
| | Mn | 730 | 730 | 730 | 730 | 730 | 730 | 730 | 730 |
| | F | 1000 | 365 | 1000 | 1000 | 365 | 365 | 365 | 365 |
| | Fe | 20 | 20 | 20 | 20 | 20 | 20 | 20 | 20 |
| | $NO_3$ | 2163 | 2163 | 2163 | 2163 | 2020 | 2163 | 2163 | 2163 |
| | $SO_4$ | 35 | 35 | 35 | 35 | 35 | 35 | 35 | 35 |
| | Al | 1.2 | 0.4 | 1 | 0.85 | 0.75 | 0.75 | 0.65 | 0.55 |
| | accelerator 1 | 200 | 600 | — | — | — | — | — | — |
| | acceterator 2 | — | — | 200 | — | — | — | — | — |
| | accelerator 3 | — | — | — | 200 | 200 | — | — | — |
| | accelerator 4 | — | — | — | — | — | 400 | — | — |
| | accelerator 5 | — | — | — | — | — | — | 400 | — |
| | accelerator 6 | — | — | — | — | — | — | — | 500 |
| | accelerator 7 | — | — | — | — | — | — | — | — |
| | accelerator 8 | — | — | — | — | — | — | — | — |
| | accelerator 9 | — | — | — | — | — | — | — | — |
| | accelerator 10 | — | — | — | — | — | — | — | — |
| | accelerator 11 | — | — | — | — | — | — | — | — |
| substrate | | steel | EGS | steel | EGS | steel | steel | steel | steel |
| crystals size ($\mu$m) | | 3 | 3 | 3 | 3 | 5 | 4 | 15 | 3 |
| surface coverage percentage | | 100 | 100 | 100 | 100 | 100 | 100 | 100 | 100 |

| | | Concentration (ppm) of the phosphatization baths in the baths | | | | | | | |
|---|---|---|---|---|---|---|---|---|---|
| | | I | J | K | L | M | N | O | P |
| Constituents of the phosphatization bath | Zn | 1025 | 1025 | 1025 | 1025 | 1025 | 1025 | 1025 | 1025 |
| | $PO_4$ | 9860 | 10550 | 9860 | 10550 | 9860 | 10550 | 10550 | 10550 |
| | Ni | 0 | 210 | 0 | 210 | 0 | 210 | 210 | 210 |
| | Mn | 730 | 730 | 1460 | 730 | 730 | 730 | 730 | 730 |
| | F | 365 | 365 | 365 | 365 | 365 | 365 | 365 | 365 |
| | Fe | 20 | 20 | 20 | 20 | 20 | 20 | 20 | 20 |
| | $NO_3$ | 2020 | 2163 | 3770 | 2163 | 2020 | 2163 | 2163 | 2163 |
| | $SO_4$ | 35 | 35 | 35 | 35 | 35 | 35 | 35 | 35 |
| | Al | 0.75 | 0.65 | 0.65 | 0.63 | 0.75 | 0.80 | 0.75 | 1 |
| | accelerator 1 | — | — | — | — | — | — | — | — |
| | accelerator 2 | — | — | — | — | — | — | — | — |
| | accelerator 3 | — | — | — | — | — | — | — | — |
| | accelerator 4 | — | — | — | — | — | — | — | — |
| | accelerator 5 | — | — | — | — | — | — | — | — |
| | accelerator 6 | 400 | — | — | — | — | — | — | — |
| | accelerator 7 | — | 400 | 400 | — | — | — | — | — |
| | accelerator 8 | — | — | — | 400 | 400 | — | — | — |
| | accelerator 9 | — | — | — | — | — | 200 | | — |
| | accelerator 10 | — | — | — | — | — | — | 400 | — |
| | accelerator 11 | — | — | — | — | — | — | — | 100 |
| substrate | | steel | steel | EGS | steel | EGS | steel | steel | steel |

TABLE B-continued

| | | | | | | | | |
|---|---|---|---|---|---|---|---|---|
| crystals size (μm) | 4 | 5 | 3 | 6 | 4 | inhibition | inhibition | 4 |
| surface converage percentage | 100 | 100 | 100 | 100 | 100 | 5 | 5 | 100 |

The examination of the results collected in table B shows that the crystalline structure obtained when using Cobalt III complexes as accelerators are as fine and homogeneous as a classical crystalline phosphatization accelerated with nitrites(test P) and that the Cobalt III salts or the Cobalt II complexes (tests N and O) have no accelerator role, as shown as well by the surface coverage percentage as the size of the small number of crystals formed.

EXAMPLE 2

Five tests (Q to U) were carried out using the accelerators 3, 7, 8 and 11 and the anti-corrosion and paint adherence performances were determined on plates treated and covered with paint of the polyester laquer type of white color hereabove identified. The compositions of the baths in the five tests and the results of the measurements carried out are collected in table C.

TABLE C

| | | Concentration (ppm) of the phosphatization baths in the baths | | | | |
|---|---|---|---|---|---|---|
| | | Q | R | S | T | U |
| Constituents of the phosphatization bath | Zn | 1025 | 1025 | 1025 | 1025 | 1025 |
| | $PO_4$ | 10550 | 9860 | 9860 | 9880 | 10550 |
| | Ni | 210 | 0 | 0 | 0 | 210 |
| | Mn | 730 | 1460 | 1460 | 730 | 730 |
| | F | 1000 | 365 | 365 | 365 | 1000 |
| | Fe | 20 | 20 | 20 | 20 | 20 |
| | $NO_3$ | 2163 | 3770 | 3770 | 2020 | 2163 |
| | $SO_4$ | 35 | 35 | 35 | 35 | 35 |
| | Al | 0.87 | 0.75 | 0.65 | 0.75 | 0.85 |
| | accelerator 3 | 200 | 400 | — | — | — |
| | accelerator 7 | — | — | 400 | — | — |
| | accelerator 8 | — | — | — | 400 | — |
| | accelerator 11 | — | — | — | — | 100 |
| substrate | | steel | steel | steel | steel | steel |
| coating weight ($g/m^2$) | | 2.96 | 2.16 | 1.74 | 0.94 | 2.8 |
| adherence | | 1 | 0 | 2 | 0 | 1 |
| SS 96h (mm) | | 3 | 5 | 6 | 6 | 7 |

Examination of the results collected in table C shows that the anti-corrosion and the paint adherence performances are equivalent in the case of substrates subjected to the accelerated phosphatizations carried out using Cobalt III complexes, or nitrites.

EXAMPLE 3

Two tests (V and W) are carried out using the accelerators 1 and 11.

Plates covered with the cataphoretic paint hereabove identified were treated and the coating weight as well as the performances in the "3C" test (Climatic Change Corrosion) were determined.

The composition of the baths and the performances as recorded result from table D.

TABLE D

| | Concentration (ppm) of the phosphatization baths in the baths | |
|---|---|---|
| | V | W |
| Constituents of the phosphatiatizon bath | | |
| Zn | 1025 | 1025 |
| $PO_4$ | 10550 | 10550 |
| Ni | 210 | 210 |
| Mn | 730 | 730 |
| F | 1000 | 935 |
| Fe | 20 | 20 |
| $NO_3$ | 2163 | 2163 |
| $SO_4$ | 35 | 35 |
| Al | 1.2 | 1 |

TABLE D-continued

| | Concentration (ppm) of the phosphatization baths in the baths | |
|---|---|---|
| | V | W |
| accelerator 1 | 100 | — |
| accelerator 11 | — | 100 |
| substrate | steel | steel |
| coating weight ($g/m^2$) | 2.1 | 1.6 |
| 3C Test | 3 mm | 2.5 mm |

From the examination of the results collected in table D, it appears that the use of Cobalt III complexes as accelerators permits obtention of a fine and homogeneous phosphatization coating which provides an excellent corrosion resistance in a comparable manner with a classical phosphatization accelerated with nitrite.

EXAMPLE 4

In this example, the stability in time of the bath according to the invention has been compared to that of a bath comprising the classical accelerator consisting of sodium nitrite.

Along the same idea, the bath according to test E (example 1) was examined after one week of ageing.

By dosage, it was established that the bath contains still about 90% of the Cobalt III complex.

A phosphatization experiment carried out using the said bath provides plates which are phosphatized in a manner which is significantly comparable to those treated with this bath at the moment of its constitution.

For comparison, the bath according to test P (example 1) was examined.

By dosage, it has been established that the said bath no longer contains accelerator after 4 hours ageing; a plate treated with this bath after ageing is not phosphatized.

We claim:

1. A process for the phosphatization of metallic substrates selected from the group consisting of aluminum, an aluminum alloy, steel, steel coated with zinc, and steel coated with a zinc alloy, wherein the zinc alloy comprises another metal selected from the group consisting of iron, nickel, aluminum, and manganese, the process comprising, phosphatizing the metallic substrate in a bath comprising as accelerator a trivalent cobalt complex selected from the group consisting of $[Co(NH_3)_6]Cl_3$ $[Co(NO_2)_6Na_3$ $[Co(en)_3](NO_3)_3$ with en=ethylenediamine $[Co(pn)_3](NO_3)_3$ with pn=diamino 1-2 propane $[Co(oxalate)en_2NO_3$ $[Co(citrate)(CO_3)]Na_2$ $[CoF(NH_3)_5](NO_3)_2$ and $[Co(NO_3)(NH_3)_5)(NO_3)_2$.

2. A process for the phosphatization of metallic substrates selected from the group consisting of aluminum, an aluminum alloy, steel, steel coated with zinc, and steel coated with a zinc alloy, wherein the zinc alloy comprises another metal selected from the group consisting of iron, nickel, aluminum, and manganese, the process comprising, phosphatizing the metallic substrate in a bath comprising from about 0.3 to about 25 g/l of zinc ion, from about 5 to about 50 g/l of phosphate ion, and from about 0.01 to about 10 g/l of a trivalent cobalt complex represented by a formula selected from the group consisting of:

$$[Co(Ligand)_n]^c \quad (I),$$

and $$[Co(Ligand)_nZ_p]^c \quad (II)$$

wherein, n and p are integers from 1 to 6 with the proviso that in the case of formula (II) $n+p \leqq 6$, c represents the charge of the complex and can consequently be positive or negative according to the charge of the Ligand and of Z, the Ligand is selected from the group consisting of the ions $NO_2$, CN, $CO_3$, oxalate ions, acetate ions, citrate ions, gluconate ions, tartrate ions, acetylacetonate ions, and compounds of formula

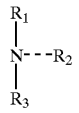

wherein $R_1$, $R_2$ and $R_3$ are selected, independently from one another, from the group consisting of hydrogen, hydroxy, alkyl, hydroxyalkyl, alkylamine, hydroxyalkylamine, carboxylic acid, aminocarboxylic acid, salts of carboxylic acid, and salts of aminocarboxylic acid, wherein the alkyl group has 1 to 6 carbons, and Z is selected from the group consisting of Cl, Br, F, I, OH, $NO_3$, SCN, $PO_4$, $SO_4$, $S_2O_3$, $MoO_4$, $SeO_4$ and $H_2O$, with the proviso that the complex according to one of formulae (I) and (II) comprises one or several Ligands and one or several Z, different from each other.

3. The process of claim 2, wherein the phosphatization bath comprises from about 0.5 to about 10 g/l of zinc ion, from 8 to about 30 g/l of phosphate ion and from about 0.03 to about 3 g/l of a trivalent cobalt complex represented by one of the formulae:

$$[Co(Ligand)_n]^c \quad (I),$$

and $$[Co(Ligand)_nZ_p]^c \quad (II).$$

4. A process for the phosphatization of metallic substrates selected from the group consisting of aluminum, an aluminum alloy, steel, steel coated with zinc, and steel coated with a zinc alloy, wherein the zinc alloy comprises another metal selected from the group consisting of iron, nickel, aluminum, and manganese, the process comprising, phosphatizing the metallic substrate in a bath comprising an accelerator comprising a trivalent cobalt complex represented by a formula selected from the group consisting of:

$$[Co(Ligand)_n]^c \quad (I),$$

and $$[Co(Ligand)_nZ_p]^c \quad (II)$$

wherein, n and p are integers from 1 to 6 with the proviso that in the case of formula (II) $n+p \leqq 6$, c represents the charge of the complex and can consequently be positive or negative according to the charge of the Ligand and of Z, the Ligand is selected from the group consisting of the ions $NO_2$, CN, $CO_3$, $SO_3$, oxalate ions, acetate ions, citrate ions, gluconate ions, tartrate ions, acetylacetonate ions, and compounds of formula

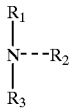

wherein $R_1$, $R_2$ and $R_3$ are selected, independently from one another, from the group consisting of hydrogen, hydroxy, alkyl, hydroxyalkyl, alkylamine, hydroxyalkylamine, carboxylic acid, aminocarboxylic acid, salts of carboxylic acid, and salts of aminocarboxylic acid, wherein the alkyl group has 1 to 6 carbons, and Z is selected from the group consisting of Cl, Br, F, I, OH, $NO_3$, SCN, $PO_4$, $SO_4$, $S_2O_3$, $MoO_4$, $SeO_4$ and $H_2O$, with the proviso that the complex according to one of formulae (I) and (II) comprises one or several Ligands and one or several Z, different from each other.

* * * * *